US007886782B1

(12) United States Patent
Curtis

(10) Patent No.: US 7,886,782 B1
(45) Date of Patent: Feb. 15, 2011

(54) TELESCOPING FUNNEL AND CONTAINER ASSEMBLY

(76) Inventor: Tony Curtis, W. 4825 State Rd. 37, Eau Claire, WI (US) 54701

( * ) Notice: Subject to any disclaimer, the term of this patent is extended or adjusted under 35 U.S.C. 154(b) by 356 days.

(21) Appl. No.: 12/288,288

(22) Filed: Oct. 18, 2008

Related U.S. Application Data

(60) Provisional application No. 60/999,363, filed on Oct. 18, 2007.

(51) Int. Cl.
*B65B 1/04* (2006.01)

(52) U.S. Cl. ..... 141/338; 141/337; 141/339; 141/340

(58) Field of Classification Search ..... 141/337–340; D12/197, 317
See application file for complete search history.

(56) References Cited

U.S. PATENT DOCUMENTS

| | | | | |
|---|---|---|---|---|
| 1,510,631 | A | 10/1924 | Nutry | |
| 1,740,418 | A * | 12/1929 | Donnelly | 141/337 |
| 4,557,378 | A * | 12/1985 | Klebold | 206/223 |
| 5,033,521 | A | 7/1991 | Martin | |
| 5,188,157 | A | 2/1993 | Lee | |
| 5,195,567 | A * | 3/1993 | Tyree, Jr. | 141/331 |
| 5,316,059 | A | 5/1994 | Lahnan et al. | |
| 5,535,793 | A | 7/1996 | Tantre | |
| D403,642 | S | 1/1999 | Acord | |
| 5,857,504 | A * | 1/1999 | Tremblay | 141/338 |
| 6,152,198 | A | 11/2000 | Nguyen | |
| 6,397,907 | B1 | 6/2002 | Heintz | |
| 6,568,440 | B1 | 5/2003 | Engelbrecht | |
| 6,837,283 | B1 * | 1/2005 | Wegner | 141/338 |
| 6,935,389 | B1 * | 8/2005 | Rinaldi | 141/337 |
| 7,014,074 | B1 * | 3/2006 | Rinaldi | 222/461 |
| 7,264,027 | B2 * | 9/2007 | Rosenbaum | 141/338 |

* cited by examiner

*Primary Examiner*—Timothy L Maust
(74) *Attorney, Agent, or Firm*—Tipton L. Randall

(57) ABSTRACT

A telescoping funnel and container assembly comprises a container member including an opening with a neck portion, which has a circular base member extending perpendicularly therefrom. The base member includes an outer, circumferential, upstanding wall portion extending opposite the container member. The neck portion has an inner shoulder section encircling the container member opening. A plurality of concentric, annular ring members, each of a selected diameter, surrounds the container member opening, with an innermost, annular ring member secured to the neck portion of the container member. The selected diameter of each annular ring member increases with distance from the neck portion. The plurality of concentric, annular ring members is contained within the upstanding wall portion of the base member and is extendable upwardly to form a funnel. A cover member is removably fastened to the upstanding wall portion of the base portion for covering the annular ring members in a collapsed state.

20 Claims, 3 Drawing Sheets

TELESCOPING FUNNEL AND CONTAINER ASSEMBLY

CROSS-REFERENCE TO RELATED APPLICATIONS, IF ANY

This application claims the benefit under 35 U.S.C. §119 (e) of provisional application Ser. No. 60/999,363, filed 18 Oct. 2007. Application Ser. No. 60/999,363 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a funnel and container assembly and, more particularly, to a telescoping funnel and container assembly and, most particularly, to a telescoping funnel and container assembly with a telescoping funnel attached to the container.

2. Background Information

Funnels are well-known devices used for directing fluid from one container to another. Funnels are fabricated in various sizes dependent upon the intended use of the device. To overcome the need to locate a funnel when it is necessary to pour fluid from one container to another, collapsible funnels that attach to and are stored at a container opening were invented. Examples of some attachable funnels for which patents have been granted include the following.

In U.S. Pat. No. 1,510,631, Nutry discloses an extension device for the breather pipe of an auto engine. The funnel portion includes thread sleeve sections that interlock with slight rotation of the extended funnel. A detachable cover fits within the collapsed sleeve sections.

Martin, in U.S. Pat. No. 5,033,521, describes an extendable cap for sealing a fluid inlet port having a holding plug, which when removed allows a telescoping funnel to be extended from a base section attached to the fluid inlet port. The extended telescoping funnel defines a fluid conduit through which a fluid may be guided into the fluid inlet port. The funnel decreases in diameter as it extends from the base connected to the engine.

U.S. Pat. No. 5,188,157 by Lee describes an extensible oil cap that includes an extensible telescoping funnel. The funnel has a plurality of cylindrical sections, with each recess disposed on the outer and each raised portion disposed on the inner thereof, for slidably moving up and down. The sections tightly lock with one another, and a cutting flange extends from the bottom of the telescoping funnel for making various size oil inlet ports. A closure member has a tubular cutter for easily opening an oil can. The funnel decreases in diameter as it extends from the base connected to the engine.

Lahnan et al., in U.S. Pat. No. 5,316,059, describe an oil filler funnel cap that replaces the normal oil filler cap on internal combustion engines. The improved, filler funnel cap is adjustable to fit a variety of different size oil filler openings, forming an enlarged funnel receptacle with a resilient sealing closure. The funnel does not collapse.

U.S. Pat. No. 5,535,793 by Tantre describes a small funnel that is adapted to engage the oil filler port on an internal combustion engine. The funnel is intended to be permanently installed and includes a cover for preventing the entry of dirt into the engine. The small diameter end is shaped to replace the manufacture's cover. The walls of the funnel near the small diameter end are pleated to allow the wide mouth end of the funnel to tip to pressure and make adding oil to the sump more convenient and eliminate oil spillage.

In U.S. Pat. No. 5,857,504, Tremblay discloses a collapsible funnel that is easily adaptable to a variety of liquid receptacles. The funnel is associated with a moveable rod, extending within the funnel, connected to a screw cap which provides for the funnel to be pushed into a liquid receptacle, through a filling spout therein, in a collapsed position when not in use. The collapsible funnel needs to be pulled out of the liquid receptacle to automatically assume a standing and extended operative position over, and in association, with the spout and facilitates the filling of the liquid receptacle, especially when the moveable rod with screw cap partially clears the way in order for funnel to easily receive the liquid.

Nguyen, in U.S. Pat. No. 6,152,198, describes a funnel that includes a base that is insertible within an existing reservoir and a plurality of fins extending outwardly from the base. The fins are configured so that they will collapse to form a tube, such that the funnel can be slid into the reservoir. Each of the tips of the fins includes lip segments, provided to form a continuous lip ring when the fins are collapsed into the tube. The preferred lip ring prevents the funnel from falling into the reservoir, while still permitting the lid of the reservoir to be attached over the funnel. The funnel's base further includes a ridge running around its periphery in order to restrain the funnel from being inadvertently removed from the reservoir when extending the funnel for use.

U.S. Pat. No. 6,397,907 by Heintz describes a telescoping funnel apparatus for directing fluid from a container. The telescoping funnel apparatus includes a funnel that includes an open top extending into a channel. The channel extends through an open bottom of the funnel allowing fluid to be directed through the funnel. A longitudinal axis of the funnel extends between the open top and bottom. A cover is provided for selectively closing the open top of the funnel. Both the base of the funnel and the base of the cap are threaded for interlocking connection.

In U.S. Pat. No. 6,568,440, Engelbrecht discloses a telescoping funnel which allows a user to pour oil into an engine. The funnel features spring ball latches, allowing the funnel to lock into place when it is expanded or compressed. When the funnel is not in use, the funnel compresses into a small size, as shown in FIG. 1.

Acord in U.S. Design Pat. No. 403,642, shows a collapsible oil filler cap that telescopes to a fully extended condition. The outer portion of the base is threaded to engage the largest telescoping section when collapsed. A cover appears to be a friction fit with the largest telescoping section of the funnel.

Applicant has devised a collapsible funnel and container assembly that overcomes many of the shortcomings of prior inventions and provides an improvement over the existing technology in the area of collapsible funnels.

SUMMARY OF THE INVENTION

The invention is directed to a telescoping funnel and container assembly. The assembly comprises a container member including an opening with a neck portion having a circular base member extending perpendicularly from the neck portion. The base member includes an outer circumferential upstanding wall portion extending opposite the container member. The neck portion of the container member has an inner shoulder section encircling the container member opening. A plurality of concentric, annular ring members, each of a selected diameter, surrounds the container member opening, with an innermost annular ring member secured to the neck portion of the container member. The selected diameter of each annular ring member increases with distance from the neck portion. The plurality of concentric, annular ring members is contained within the base member's upstanding wall portion, the ring members extendable upwardly from the neck portion to form a funnel. A cover member is removably fastened to the base portion's upstanding wall portion for covering the plurality of concentric, annular ring members in a collapsed state.

In a preferred embodiment of the invention, the innermost, annular ring member includes a plurality of attachment hooks extending beneath the inner shoulder section of the neck portion, thereby securing the innermost, annular ring member to the neck portion of the container member.

DESCRIPTION OF THE EMBODIMENTS

Nomenclature

Figure 1:
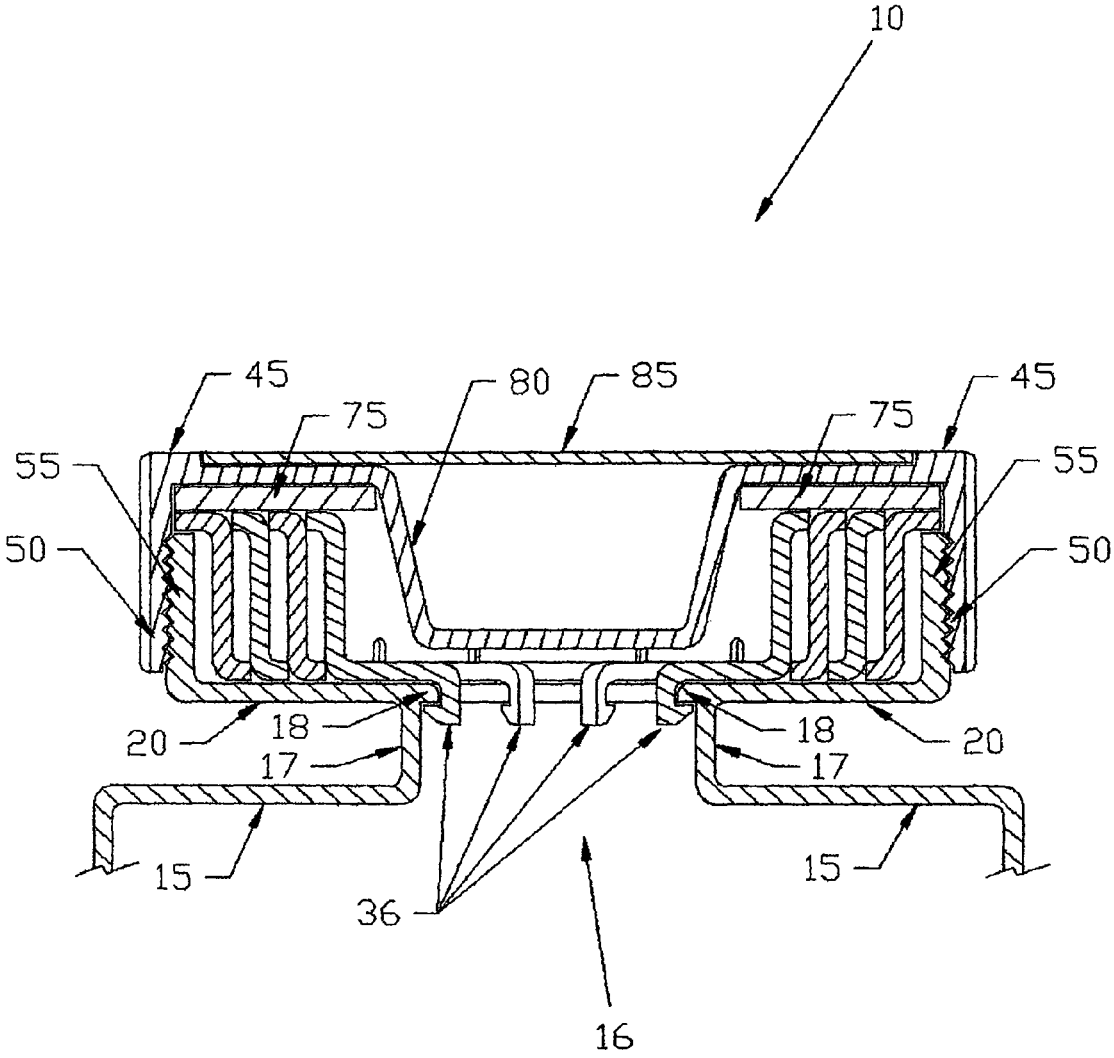
FIG. 1 is a cross sectional view of the collapsible funnel and container assembly of the present invention in the collapsed and closed condition.
Figure 2:
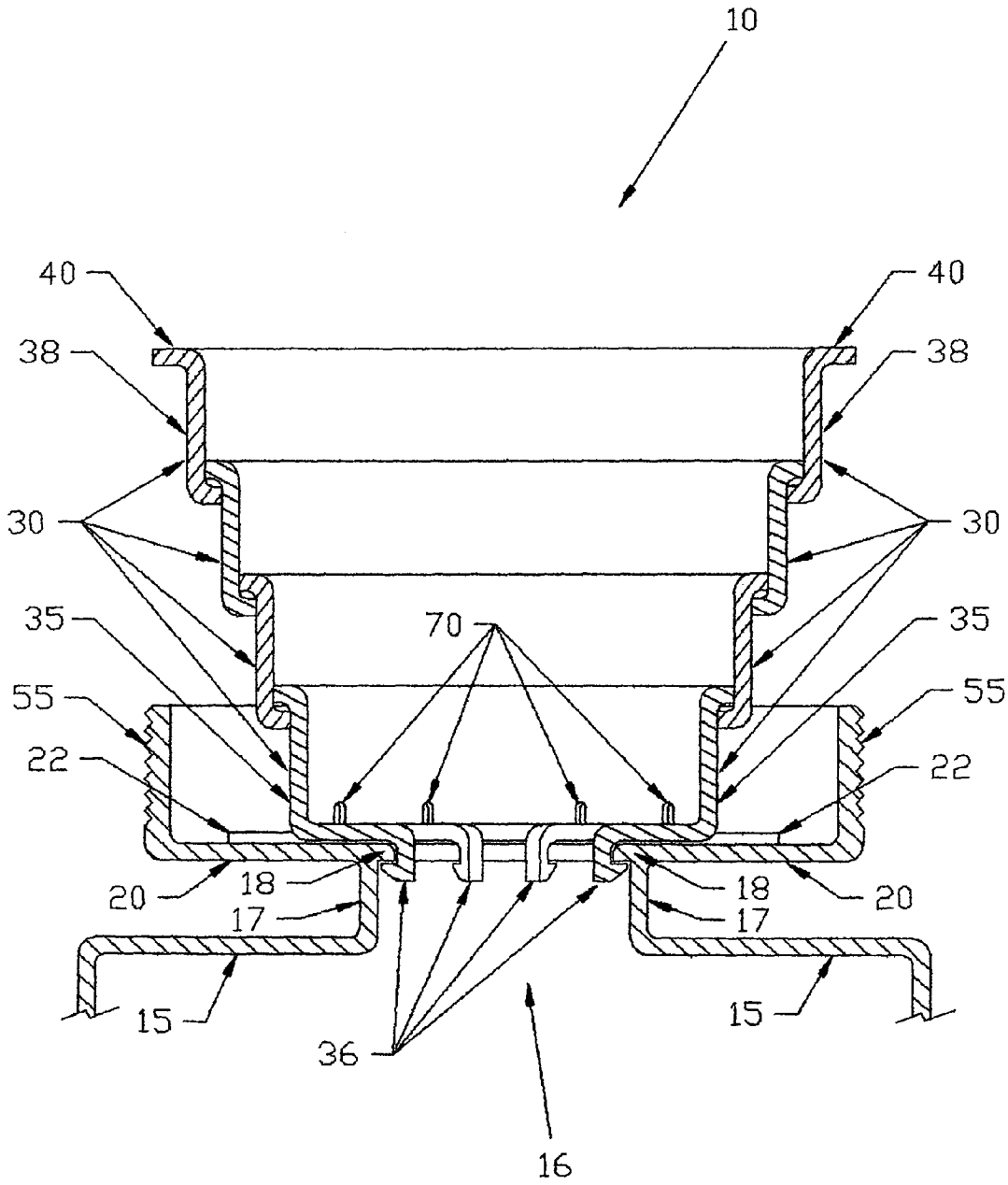
FIG. 2 is a cross sectional view of the collapsible funnel and container assembly of the present invention in the extended and open condition.

10 Telescoping Funnel and Container Assembly
15 Container Member
16 Opening of Container Member
17 Neck Portion of Container Member
18 Shoulder Section of Neck Portion
20 Circular Base Member
22 Radial Ridges of Base Member
25 Outer Circumferential Upstanding Wall Portion of Base Member
27 Pin Member on Wall Portion of Base Member
30 Concentric, Annular Ring Members
35 Innermost Ring Member
36 Attachment Hooks of Innermost Ring Member
38 Outermost Ring Member
40 Lifting Lip Portion of Outermost Ring Member
45 Cover Member
47 Locking Slotg in Cover Member
50 Threaded Surface of Cover Member
55 Threaded Surface of Upstanding Wall
70 Drain Slots of Innermost Ring Member
75 Cover Gasket Member
80 Plug of Cover Member
85 Cover Disk Member Containing Logo

Construction

The invention is a telescoping funnel and container assembly. The assembly comprises a container member including an opening with a neck portion, having a circular base member extending perpendicularly from the neck portion. The base member includes an outer circumferential upstanding wall portion extending opposite the container member. The neck portion of the container member has an inner shoulder section encircling the container member opening. A plurality of concentric, annular ring members each of a selected diameter, surrounds the container member opening, with an innermost annular ring member secured to the neck portion of the container member. The selected diameter of each annular ring member increases with distance from the neck portion. The plurality of concentric, annular ring members is contained within the base member's upstanding wall portion, the ring members extendable upwardly from the neck portion to form a funnel. A cover member is removably fastened to the base portion's upstanding wall portion for covering the plurality of concentric, annular ring members in a collapsed state.

In a preferred embodiment of the invention, the innermost annular ring member includes a plurality of attachment hooks extending beneath the inner shoulder section of the neck portion, thereby securing the innermost annular ring member to the neck portion of the container member.

Referring now the FIGURES, one embodiment of the telescoping funnel and container assembly is illustrated. The telescoping funnel and container assembly 10 comprises a container member 15 that includes an opening 16 with a neck portion 17, having a circular base member 20 extending perpendicularly from the neck portion 17. The base member 20 includes an outer circumferential, upstanding wall portion 25 extending opposite the container member 15. The neck portion 17 of the container member 15 has an inner shoulder section 18 encircling the container member opening 16. A plurality of concentric, annular ring members 30, each of a selected diameter, surrounds the container member opening 16, with an innermost, annular ring member 35 secured to the neck portion 17 of the container member 15. Preferably, the innermost, annular ring member 35 includes a plurality of attachment hooks 36 extending beneath the inner shoulder section 18 of the neck portion 17, thereby securing the innermost annular ring member 35 to the neck portion 17 of the container member 15. The selected diameter of each annular ring member 30 increases with distance from the neck portion 17.

The plurality of concentric, annular ring members 30 is contained within the upstanding wall portion 25 of the base member 20, the ring members 30 extendable upwardly from the neck portion 17 to form a funnel. A cover member 45 is removably fastened to the upstanding wall portion 25 of the base member 20 for covering the plurality of concentric, annular ring members 30 in a collapsed state. Preferably, the cover member 45 includes an inner threaded surface 50, and the upstanding wall 25 of the base member 20 includes a mating threaded surface 55 for securing the cover member 45 atop the base member 20. Alternatively, the cover member 45 includes a locking slot 47 and the upstanding wall 25 of the base member 20 includes a pin member 27 engagable with the locking slot for securing the cover member 45 atop the base member 20.

In further embodiments of the invention, the plurality of concentric, annular ring members 30 includes an outermost ring member 38 with an upper lip portion 40 thereon for extending the ring members 30 to form a funnel. Additionally, The base member 20 includes a floor with a plurality of radial ridges 22 for elevating the concentric, annular ring members 30 above the floor of the base member 20. The radial ridges 22 allow any fluid on the annular ring members 30 to drain onto the base member 20 during storage. In conjunction with this feature, the innermost, annular ring member 35 includes a plurality of drainage slots 70 adjacent the neck portion 17 of the container member 15 for draining fluid from the collapsed, annular ring members 30 into the container member 15.

Figure 3:
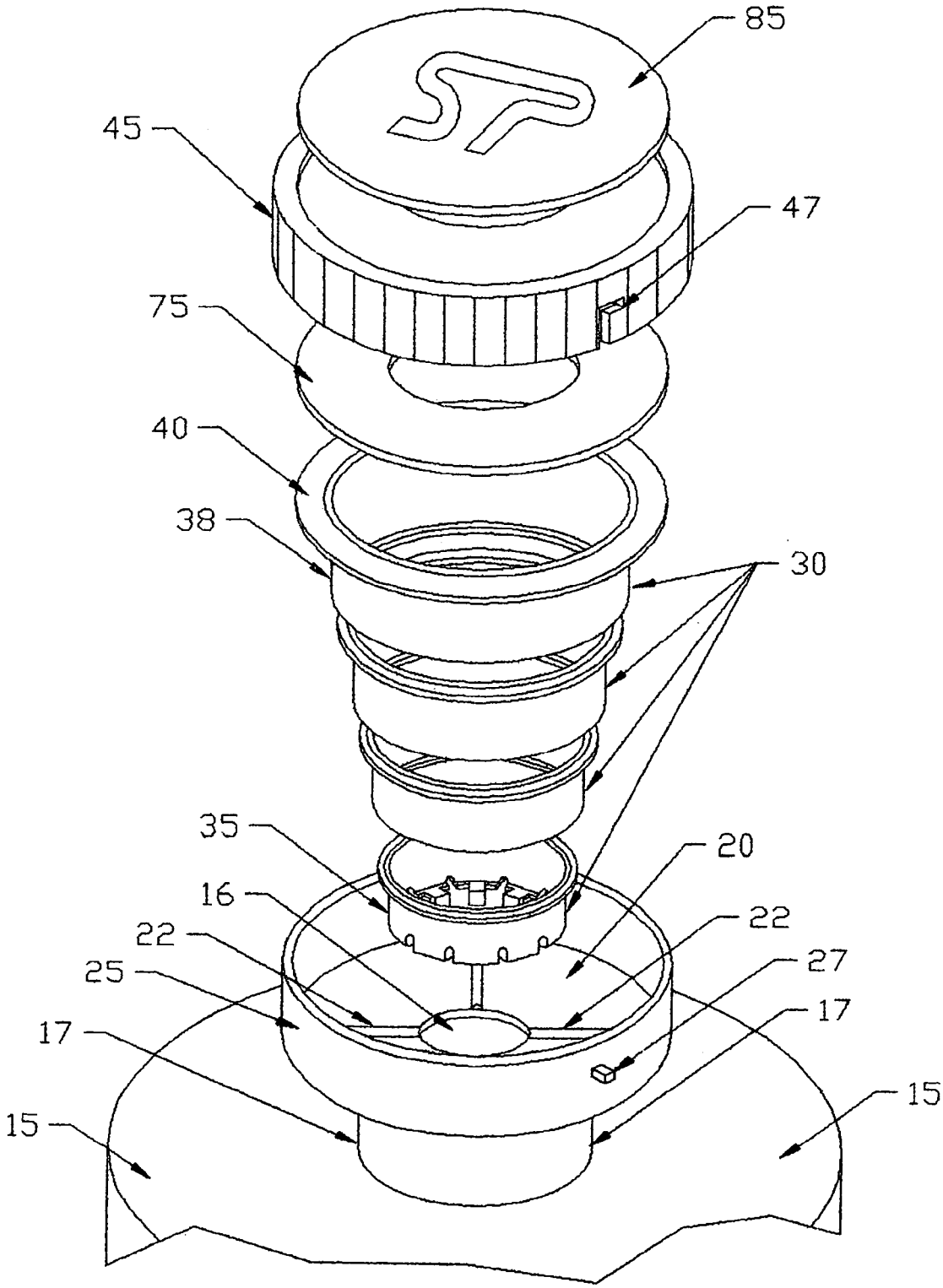
FIG. 3 is an exploded perspective view of the collapsible funnel and container assembly of the present invention.

In yet further embodiments of the invention, there is a plug member 80 secured to an interior surface of the cover member 45. The plug member 80 is positioned against the opening 17 of the container member 15, with the cover member 45 closed on the base member 20, as illustrated in FIG. 1. Additionally, a cover gasket member 75 (FIG. 3) is positioned within the cover member 45 for sealing the cover member 45 against the circular base member 20 to prevent leakage of fluid there between.

A cover disk member 85 is attachable to the outer surface of the cover member 45 for display of a logo or any similar marking that may be desired.

While the invention has been particularly shown and described with reference to preferred embodiments thereof, it will be understood by those skilled in the art that various changes in form and details may be made therein without departing from the spirit and scope of the invention.

I claim:

1. A telescoping funnel and container assembly comprising:

a container member including an opening with a neck portion having a circular base member extending perpendicularly from the neck portion, the base member including an outer, circumferential, upstanding wall portion extending opposite the container member;

the neck portion of the container member having an inner shoulder section encircling the container member opening;

a plurality of concentric, annular ring members, each of a selected diameter, with an innermost, annular ring member secured to the neck portion of the container member, the selected diameter of each annular ring member increasing with distance from the neck portion, the plurality of concentric, annular ring members contained within the upstanding wall portion of the base member, the ring members extendable upwardly from the neck portion to form a funnel; and a cover member removably fastened to the upstanding wall portion of the base member for covering the plurality of concentric, annular ring members in a collapsed state.

2. The telescoping funnel and container assembly of claim 1, wherein the innermost annular ring member includes a plurality of attachment hooks extending beneath the inner shoulder section of the neck portion, thereby securing the innermost annular ring member to the neck portion of the container member.

3. The telescoping funnel and container assembly of claim 1, wherein the cover member and upstanding wall of the base member include mating threaded surfaces for securing the cover member atop the base member.

4. The telescoping funnel and container assembly of claim 1, wherein the cover member includes a locking slot, and the upstanding wall of the base member includes a pin member engagable with the locking slot for securing the cover member atop the base member.

5. The telescoping funnel and container assembly of claim 1, wherein the plurality of concentric, annular ring members includes an outermost ring member with an upper lip portion thereon for extending the ring members to form a funnel.

6. The telescoping funnel and container assembly of claim 1, wherein the base member includes a floor with a plurality of radial ridges for elevating the concentric, annular ring members above the floor of the base member.

7. The telescoping funnel and container assembly of claim 1, further including a plurality of drainage slots in the innermost, annular ring member, adjacent the neck portion of the container member for draining fluid from the collapsed annular ring members.

8. The telescoping funnel and container assembly of claim 1, further including a plug member secured to an interior surface of the cover member, the plug member positioned against the container member's opening with the cover member closed on the base member.

9. The telescoping funnel and container assembly of claim 1, further including a cover gasket member within the cover member for sealing the cover member against the circular base member.

10. A telescoping funnel and container assembly comprising:

a container member including an opening with a neck portion having a circular base member extending perpendicularly from the neck portion, the base member including an outer, circumferential, upstanding wall portion extending opposite the container member;

the neck portion of the container member having an inner shoulder section encircling the container member opening;

a plurality of concentric, annular ring members, each of a selected diameter, with an innermost, annular ring member secured to the neck portion of the container member by a plurality of attachment hooks extending beneath the inner shoulder section of the neck portion, the selected diameter of each annular ring member increasing with distance from the neck portion, the plurality of concentric, annular ring members contained within the upstanding wall portion of the base member, the ring members extendable upwardly from the neck portion to form a funnel;

the base member including a floor with a plurality of radial ridges for elevating the concentric, annular ring members there above; and a cover member removably fastened to the upstanding wall portion of the base member for covering the plurality of concentric, annular ring members in a collapsed state.

11. The telescoping funnel and container assembly of claim 10, wherein the cover member and upstanding wall of the base member include mating threaded surfaces for securing the cover member atop the base member.

12. The telescoping funnel and container assembly of claim 10, wherein the cover member includes a locking slot, and the upstanding wall of the base member includes a pin member engagable with the locking slot for securing the cover member atop the base member.

13. The telescoping funnel and container assembly of claim 10, wherein the plurality of concentric, annular ring members includes an outermost ring member with an upper lip portion thereon for extending the ring members to form a funnel.

14. The telescoping funnel and container assembly of claim 10, further including a plurality of drainage slots in the innermost, annular ring member, adjacent the neck portion of the container member for draining fluid from the collapsed annular ring members.

15. The telescoping funnel and container assembly of claim 10, further including a plug member secured to an interior surface of the cover member, the plug member positioned against the container member's opening with the cover member closed on the base member.

16. The telescoping funnel and container assembly of claim 10, further including a cover gasket member within the cover member for sealing the cover member against the circular base member.

17. A telescoping funnel and container assembly comprising:

a container member including an opening with a neck portion having a circular base member extending perpendicularly from the neck portion, the base member including an outer, circumferential, upstanding wall portion extending opposite the container member;

the neck portion of the container member having an inner shoulder section encircling the container member opening;

a plurality of concentric, annular ring members, each of a selected diameter, with an innermost, annular ring member secured to the neck portion of the container member by a plurality of attachment hooks extending beneath the inner shoulder section of the neck portion, the selected diameter of each annular ring member increasing with distance from the neck portion, the plurality of concentric, annular ring members contained within the upstanding wall portion of the base member, with an outermost ring member having an upper lip portion thereon for extending the ring members upwardly from the neck portion to form a funnel;

the base member including a floor with a plurality of radial ridges for elevating the concentric, annular ring members there above;

the innermost, annular ring member including a plurality of drainage slots therein, adjacent the neck portion of the container member, for draining fluid from the collapsed annular ring members; and a cover member removably fastened to the upstanding wall portion of the base member for covering the plurality of concentric, annular ring members in a collapsed state.

18. The telescoping funnel and container assembly of claim 17, wherein the cover member and upstanding wall of the base member include mating threaded surfaces for securing the cover member atop the base member.

19. The telescoping funnel and container assembly of claim 17, wherein the cover member includes a locking slot, and the upstanding wall of the base member includes a pin member engagable with the locking slot for securing the cover member atop the base member.

20. The telescoping funnel and container assembly of claim 17, further including a plug member secured to an interior surface of the cover member, the plug member positioned against the container member's opening with the cover member closed on the base member; and a cover gasket member within the cover member for sealing the cover member against the circular base member.

* * * * *